US006419338B1

(12) United States Patent
Ikeda

(10) Patent No.: US 6,419,338 B1
(45) Date of Patent: Jul. 16, 2002

(54) PRINTING APPARATUS AND A PRINTING METHOD

(75) Inventor: Keiichi Ikeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/544,136

(22) Filed: Apr. 6, 2000

(30) Foreign Application Priority Data

Apr. 8, 1999 (JP) ..... 11-101386

(51) Int. Cl.[7] ..... B41J 29/38; B41J 23/00
(52) U.S. Cl. ..... 347/14; 347/37
(58) Field of Search ..... 347/14, 19, 23, 347/37

(56) References Cited

U.S. PATENT DOCUMENTS 5,873,663 A * 2/1999 Yokoi et al. ..... 400/279
5,894,315 A * 4/1999 Yamane ..... 347/37

* cited by examiner

*Primary Examiner*—John Barlow
*Assistant Examiner*—Alfred Dudding
(74) *Attorney, Agent, or Firm*—Fitzpatrick, Cella, Harper & Scinto

(57) ABSTRACT

The present invention provides a printing apparatus that allows high-speed printing of a high quality image on a printing medium without a variation in the scanning speed of a printing head and a method for printing a high quality image on a printing medium using such a novel printing apparatus. For that purpose, an encoder pulse is generated whenever the printing head shifts its position a predetermined distance and a scanning speed of the printing head is detected from an interval of the encoder pulses. Thus, the amount of deviation with respect to output timing of heat pulses for actuating the printing head in response to the scanning speed can be determined.

12 Claims, 12 Drawing Sheets

X1=VCr1× (S/v)

X2=VCr2× (S/v)

PRINTING APPARATUS AND A PRINTING METHOD

This application is based on Patent Application No. 11-101386 (1999) filed Apr. 8, 1999 in Japan, the content of which is incorporated hereinto by reference.

BACKGROUND OF THE INVENTION

1. Field of the Invention

The present invention relates to a printing apparatus and a printing method for printing an image on a printing medium by actuating a printing head such as an inkjet printing head under its scanning movement.

2. Description of the prior Art

FIG. 2 shows an example of a printing apparatus that can be constructed as a main part of an inkjet color printer or the like. For printing an image on a sheet of printing paper 105 being placed on a platen 106, at first, a driving motor 103 is activated to drive a driving belt 109 by which a carriage 102 is shifted to a position facing a home-position sensor 108 in the direction of main-scanning (i.e., the direction perpendicular to the direction of feeding the sheet of printing paper). Then, the carriage 102 moves forward in a scanning movement in the direction of the arrow A to bring printing heads 120, 121, 122, and 123 toward a predetermined scanning area. These printing heads 120–123 are respectively provided for ejecting black (K), cyan (C), magenta (M), and yellow (Y) color inks. These color inks are ejected onto a sheet of printing paper 105 to make an image while the carriage travels through the predetermined scanning area. The forward-scanning movement of the carriage 102 is stopped when the image printing of a predetermined length is terminated. Subsequently, the carriage 102 starts to move in the reverse direction toward the position facing the home-position sensor 108 as a reverse-scanning movement thereof in the direction of the arrow B. During the reverse-scanning movement, a paper-feed motor 107 drives a paper-feed roller 105 to feed the paper in the direction of the arrow C (i.e., sub-scanning direction). Repeating the cycle of these steps, the printing of a color image on the printing paper 105 can be completed. In the figure, by the way, the reference numeral 100 denotes a second paper-feed roller and 111 denotes a sensor for detecting the presence or absence of paper on the platen 106.

Referring now to FIG. 3, there is shown the relationship between a speed of the carriage 102 that moves in the direction of forward-scanning and an interval of time required for printing a line of image. In the figure, the motor 103 is activated at a point of time indicated by the reference numeral 130 to move the carriage 102 in the direction of forward scanning. During the period T1 (i.e., acceleration time), the carriage 102 is accelerated. After the point of time 131 at which the carriage 102 reaches a predetermined speed, the printing heads 120, 121, 122, and 123 start ink ejection respectively to form an image on a sheet of paper. At the point of time 132 after lapse of the time T2, the printing movement is terminated and the carriage 102 is decelerated. Finally, the carriage 102 comes to a stop at the point of time 133 after lapse of the time T3. Accordingly, the printing movement of the conventional printing apparatus requires several steps as described above because of the impossibility of an increase in the rotational speed of the motor right up to the printing speed of the carriage 102. Furthermore, the printing speed is also defined by the printing resolution and the refill frequency. In this description, by the way, the term "printing speed" means a speed of the carriage during the interval of ejecting ink from the printing heads; and the term of "refill frequency" means a number of times each of the printing heads 120, 121, 122, and 123 is refilled with ink after ejecting ink within a specified interval.

The printing speed of the carriage 102 can be calculated, for example, by the following equation (1).

$$V=(25.4/R)\times F \quad (1),$$

wherein "R" denotes a printing resolution (dots per inch); "F" denotes a refill frequency (10 kHz); "V" denotes a printing speed (millimeter per second); and "25.4" is a scale factor (i.e., one inch is equal to 25.4 millimeters).

If "R"=600 dpi and "F"=10 kHz, for example, then the printing speed "V" can be calculated using the above equation (1) as follows.

$$V=(25.4/R)\times F=(25.4/600)\times 10000=423.33 \text{ (mm/s)}.$$

In this case, therefore, the carriage 102 shifts its position at that speed. A linear encoder (not shown) optically or magnetically recognizes the scanning position of the carriage 102. Thus, the printing heads eject ink droplets with reference to output signals from the linear encoder, resulting in an image formed by equally placing the ink dots on a sheet of the printing paper 105. Accordingly, the above description facilitates the understanding of the need for the intervals of time for acceleration and deceleration of the carriage 102 to attain the formation of equally distributed ink dots.

FIG. 4 illustrates the example of ejecting ink from the printing head at the time of accelerating and decelerating the carriage 102. In the figure, a solid line 300 indicates the relationship between the carriage's speed and time just as is the case with FIG. 3. Encoder pulses 301 are generated from the linear encoder (not shown) that optically or magnetically recognizes the scanning position of the carriage 102. If the printing head ejects an ink droplet by the falling edge of an encoder pulse, a dot to be formed on a sheet of the printing paper 105 can be represented by the reference numeral 302, as schematically shown in FIG. 4. During the intervals of accelerating and decelerating the carriage 102, as can be seen from FIG. 4, dots are not equally distributed on the printing paper 105. This means that a locus of a flying ink droplet is changed with respect to the scanning speed of the carriage 102. That is, an ink droplet ejected from the printing head reaches a point which is displaced a distance "X1" from a predetermined point in the direction of carriage travel. The distance "X1" can be expressed by the following equation (2).

$$X1=VCr1\times(S/V) \quad (2),$$

wherein, "S" denotes a distance between the printing head and a sheet of the printing paper 105 (see FIG. 5A); "V" denotes a speed of an ink droplet ejected from the printing head (see FIG. 5B); and "VCrl" denotes a speed of the carriage that travels in the direction of forward-scanning (see FIG. 5B).

According to the equation (1), as shown in FIG. 5C, the deviation "X1" doubles (i.e., 2×X1=X2) as the carriage speed "VCr1" doubles (i.e., 2×VCr1=VCr2). Therefore, the conventional printing apparatus must start the printing after the carriage attains a constant speed and also controls the carriage so as to be kept at a constant speed during the step of printing an image on the printing paper.

Regarding the movement of the carriage 102 during the step of printing, the conventional example described above requires both acceleration and deceleration times T1, T3 in addition to the actual printing time T2, so that the conventional approach takes a long time to complete the entire process, resulting in difficulty of attaining the high-speed printing movement. It means that a needless or wasted time (T1+T3) is required for printing a band (i.e., an amount of image which can be printed by one scanning movement of the carriage). If the number of the scanning movements of the carriage 102 to be required for printing a page (i.e., one complete image to be printed on one side of a sheet of paper) is "N", there is a needless time "(T1+T3)×N" in addition to an actual printing time "T2×N". In this case, furthermore, attention must be directed toward additional spaces extending in the directions of both forward and reverse movements of the carriage, respectively. Such spaces are required for both the acceleration and deceleration movements by the time "T1+T3". Consequently, due to such additional spaces, the width of the printing apparatus becomes large.

The conventional printing apparatus has another disadvantage in that a quality of the image may decline as a result of variations in the spaces between dots printed on the printing paper when a variation in the speed of the carriage mechanically occurs in spite of printing an image only in the phase of moving the carriage at a constant speed.

SUMMARY OF THE INVENTION

An object of the present invention is to provide a printing apparatus that allows high-speed printing of a high quality image on a printing medium without a variation in the scanning speed of a printing head and a method for printing a high quality image on a printing medium using such a novel printing apparatus.

According to one aspect of the present invention, a printing apparatus, for printing an image on a printing medium on the basis of image data by actuating a printing head during a scanning movement of the printing head, includes detecting means and compensating means. The detecting means detects a scanning speed of the printing head. The compensating means establishes the amount of deviation with respect to timing for actuating the printing head in response to the scanning speed detected by the detecting means.

According to another aspect of the present invention, a method, for printing an image on a printing medium on the basis of image data by actuating a printing head during a scanning movement of the printing head, includes the steps of detecting a scanning speed of the printing head and establishing the amount of deviation with respect to timing for actuating the printing head in response to the scanning speed detected in the detecting step.

The present invention is able to correct the timing of activating a printing head (e.g., inkjet printing head) in response to a scanning speed thereof, so that high quality image formation with equally distributed pixels such as ink dots on a printing medium can be attained whether or not variations in a scanning speed of the printing head are generated.

The present invention also allows high quality image formation whether or not a variation of the scanning speed occurs at the time of moving the printing head at a predetermined constant speed.

The above and other objects, features and advantages of the present invention will become more apparent from the following description of embodiments thereof taken in conjunction with the accompanying drawings.

DETAILED DESCRIPTION OF THE PREFERRED EMBODIMENTS

First Embodiment

Figure 1:
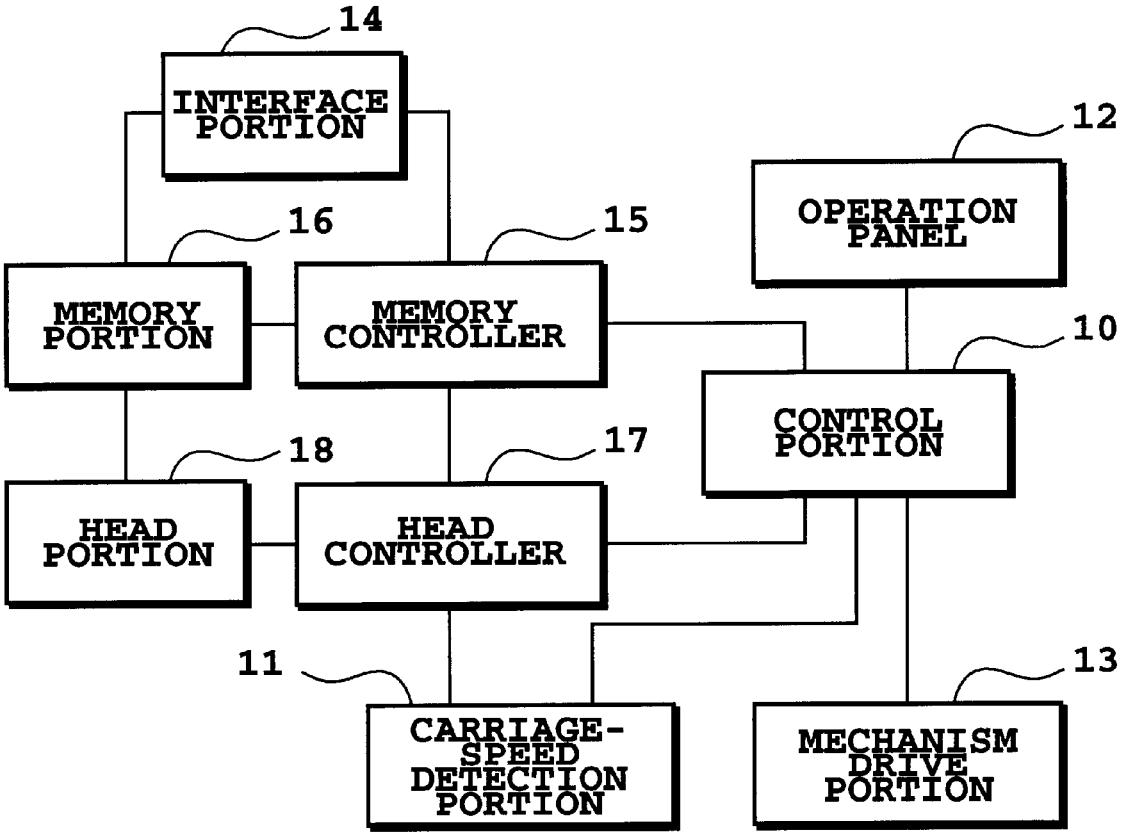
FIG. 1 is a block diagram for illustrating a control system of the inkjet printing apparatus in a first embodiment of the present invention.

FIG. 1 is a block diagram for illustrating a control system of an inkjet printing apparatus in a first embodiment of the present invention. The control system comprises several portions for controlling the functions of the inkjet printing apparatus. In the figure, the reference numeral 10 denotes a control portion that controls the entire printing apparatus. Also, the reference numeral 11 denotes a carriage-speed detection portion that detects the speed of a carriage in a mechanism-driving portion 13 concurrently with the movement of the carriage by measuring the periodicity of encoder pulses from a linear encoder (not shown). In addition, the carriage-speed detection portion 11 generates a speed-detected signal as an output every time it detects the speed of the carriage. The control portion 10 is able to read the carriage speed from the carriage-speed detection portion 11 in real time by introducing the speed-detected signal into an interruption terminal of a microprocessor (MPU) in the control portion 10.

Figure 2:
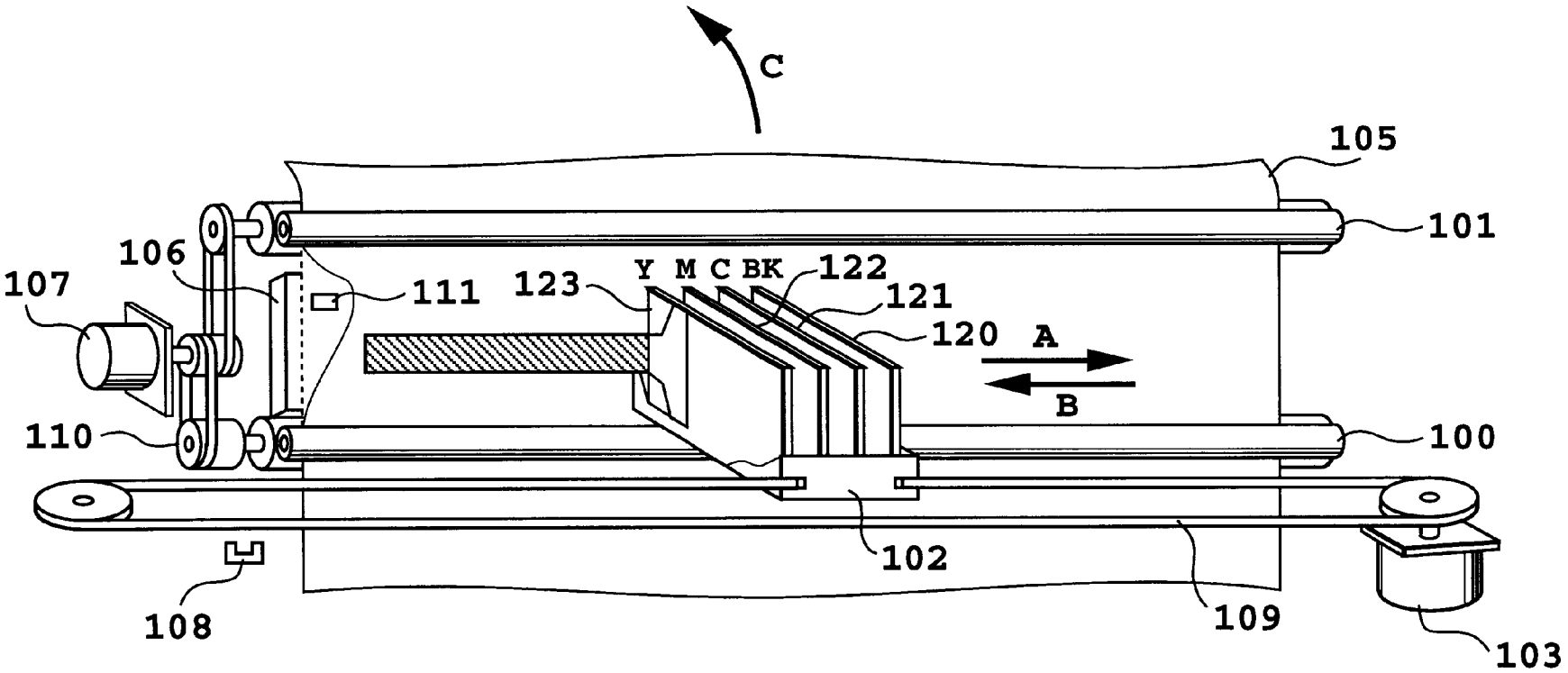
FIG. 2 is schematic diagram for illustrating a main part of the inkjet printing apparatus.
Figure 3:
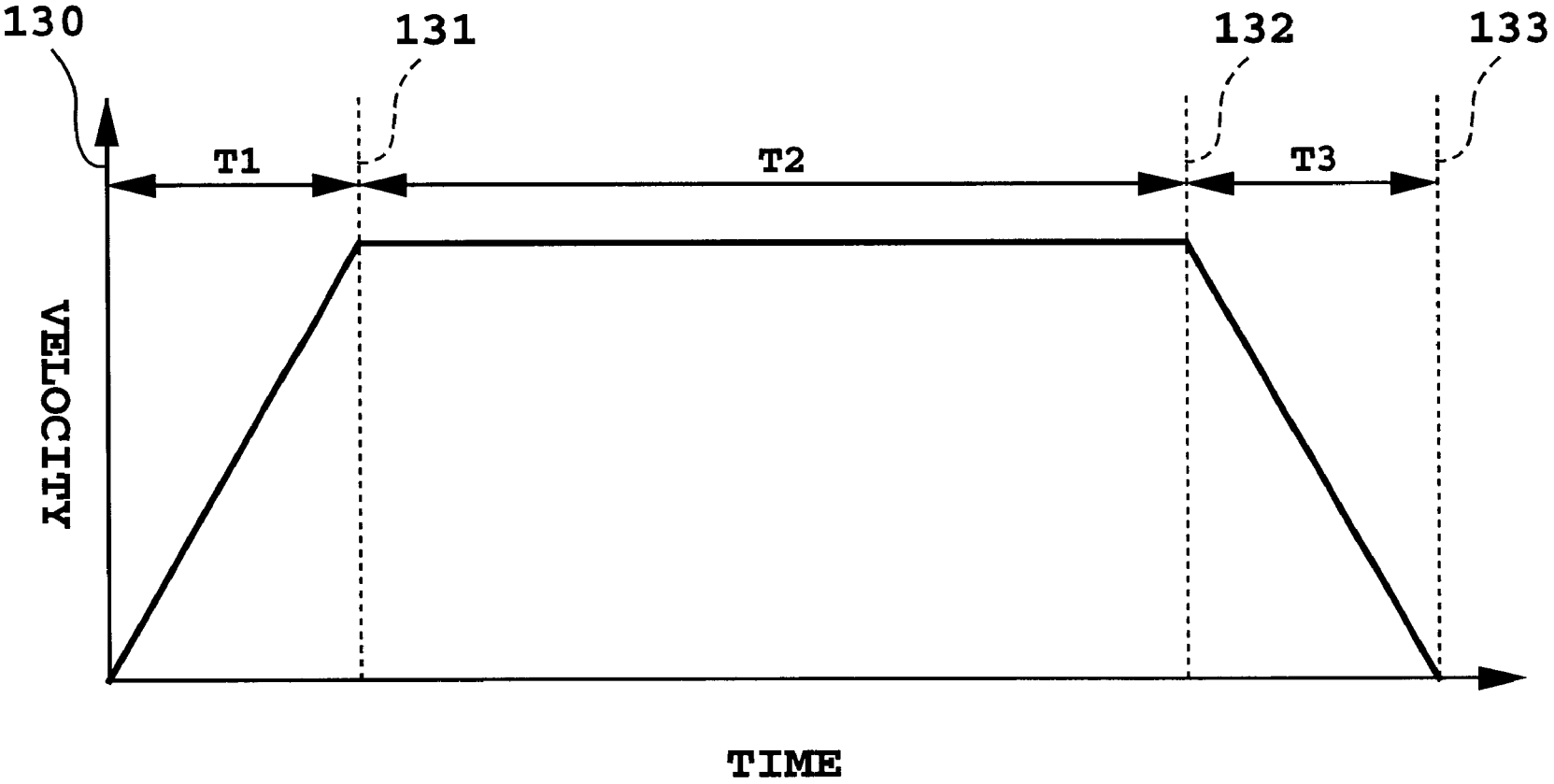
FIG. 3 is an explanation view for illustrating the relationship between a speed of the carriage in the inkjet printing apparatus of FIG. 2 and an interval of time required for printing a line of an image.
Figure 4:
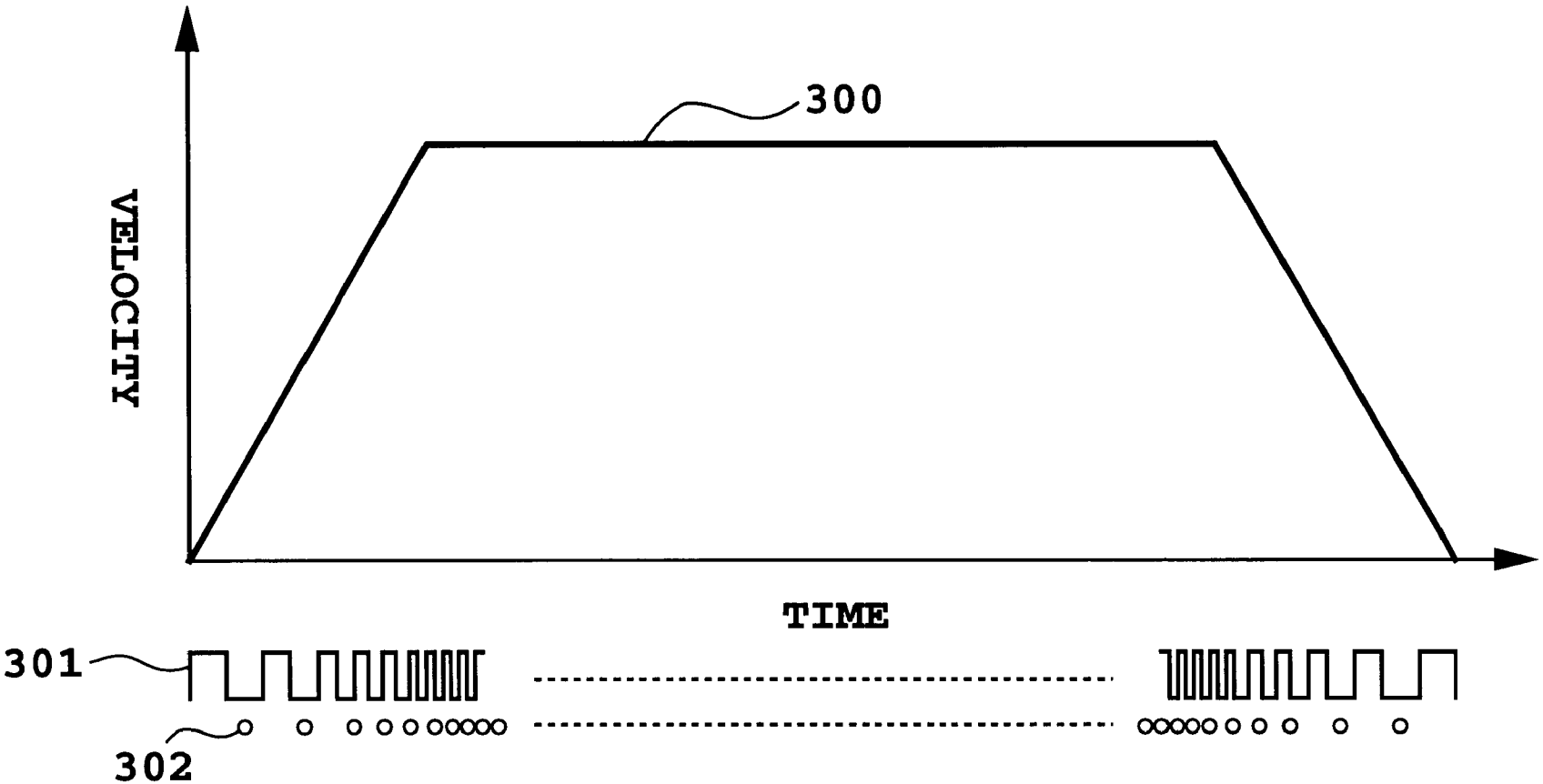
FIG. 4 is an explanation view for illustrating the example of ejecting ink from the printing head at the time of accelerating and decelerating the carriage in accordance with the configuration of the conventional inkjet printing apparatus.
Figure 5B:
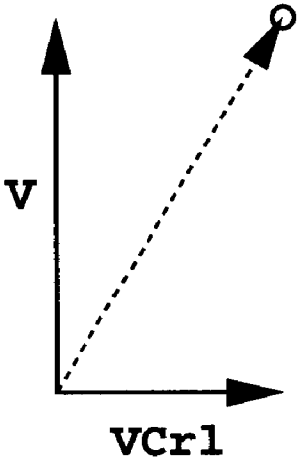
FIG. 5A, FIG. 5B, and FIG. 5C are explanation views for illustrating the relationship between the speed of the carriage and the positions on which ink droplets are placed in accordance with the conventional inkjet printing apparatus.
Figure 5C:
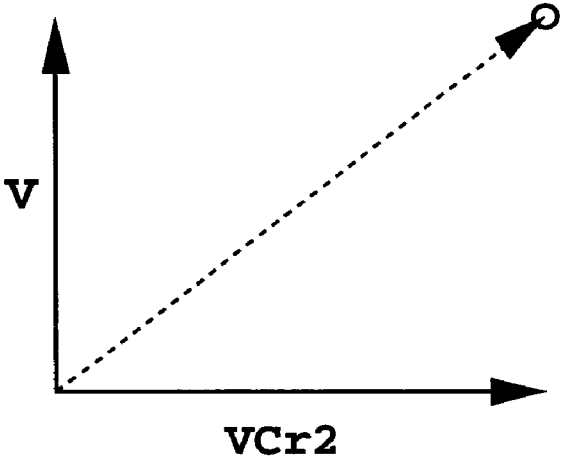
Figure 5A:
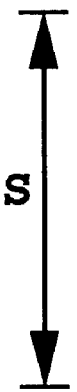

The mechanism-driving portion 13 has substantially the same configuration as that of the conventional one shown in FIG. 2 and comprises a carriage 102 for transferring printing heads 120, 121, 122, 123 in the direction of main-scanning; a drive portion for reciprocally moving the carriage 102; a paper-feed assembly including a paper-input mechanism, a paper-transfer mechanism, and a paper-output mechanism for passing a sheet of printing paper through the printing apparatus; a recovery portion for recovering the printing heads 120–123 from being clogged with ink; and so on. In FIG. 1, the printing heads 120–123 are represented as a head portion 18. The reference numeral 12 denotes an operation panel comprising switches for entering information of paper-feeding, paper-output, type of printing paper, and so on and an indicator system for indicating the conditions of the inkjet printing apparatus. The operation panel 12 checks the above switches and indicates the conditions thereof under the control of the control portion 10. The reference numeral 14 denotes an interface (I/F) portion being connected to a host computer (host device, not shown). The host computer sends any commands and printing data to the inkjet printing apparatus through the I/F portion 14. The commands from the host computer invoke the functions of the inkjet printing apparatus to print the data. The I/F portion 14 may be a Centronics interface or a small computer system interface (SCSI). The reference numeral 15 denotes a memory controller that transfers a command passing through the I/F portion 14 to the control portion 10 and generates an address and a write-timing signal so as to write the printing data on the memory portion 16 under the control of the control portion 10. Furthermore, the control portion 10 interprets the command entered from the I/F portion 14 and then controls the inkjet printing apparatus in its entirety. The memory portion 16 is comprised of one or more memory chips where information can be stored and retrieved. The information is the amount of printing data corresponding to at least one band to be printed by one scanning movement of the printing head in the direction of main-scanning. The capacity of the memory portion 16 may be calculated as follows. If each of the printing heads has 128 nozzles arranged in the direction of sub-scanning (i.e., the direction of transferring a sheet of printing paper 105) and the maximum number of dots to be printed by one scanning movement of the printing head in the direction of main-scanning is 8,000 dots, the memory capacity required for the printing movement of the printing head portion is 4 Mbit as a result of the following equation.

$$128\ (\text{nozzles}) \times 8{,}000\ (\text{dots}) \times 4\ (\text{colors}) = 4\ \text{Mbit}.$$

The reference numeral 17 denotes a head controller that receives the printing data from the memory controller 15 and the memory portion 16 in synchronization with a read out signal from the head controller 17 under the control of the control portion 10.

The reference numeral 18 denotes a printing head portion comprising inkjet printing heads 120–123 (see FIG. 2) that correspond to their respective colors. The printing head portion 18 is installed on the carriage 102 (see FIG. 2) in the mechanism drive portion 13. Each of the heads 120–123 has a plurality of nozzles as described above. Every nozzle has an orifice for ejecting ink using a film boiling phenomenon that occurs when ink is partially heated by a heater portion (an electrothermal element). Thus, an image can be printed on a sheet of the printing paper by selectively activating the electrothermal elements to eject ink from the corresponding orifices under the control of both the control portion 10 and the head controller 17.

That is, the head controller 17 generates timing signals for ink ejection and heat pulses (pulses for activating the heater portions) under the control of the control portion 10.

Figure 6:
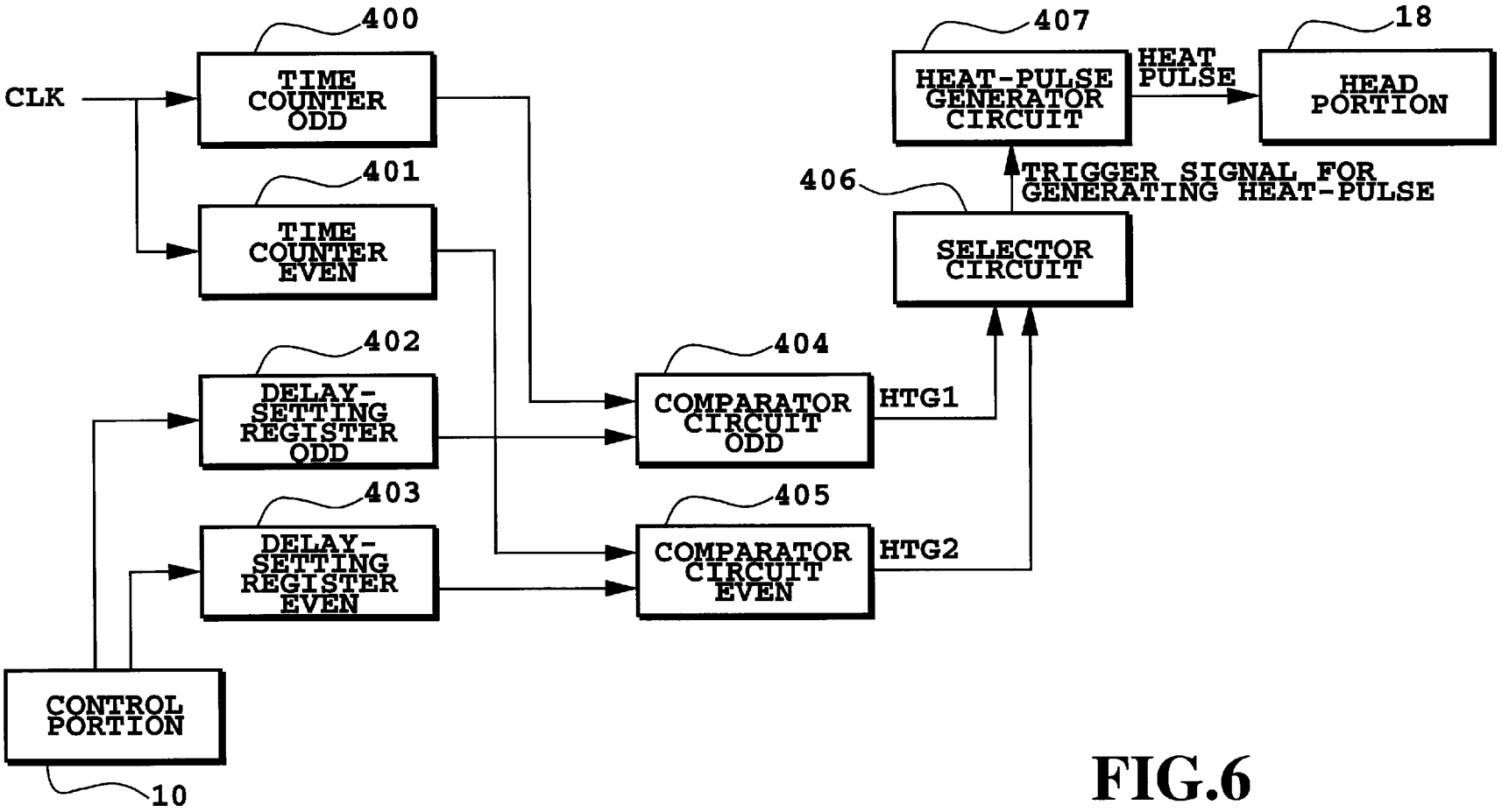
FIG. 6 is a block diagram for illustrating a main part of the inkjet printing apparatus in the first embodiment of the present invention.

FIG. 6 is a block diagram of a heat pulse generator portion of the head controller 17 in accordance with the present embodiment. In the figure, the reference numeral 402 denotes a delay-setting register ODD and 403 denotes a delay-setting register EVEN, which can be adjusted to operate as desired by the control portion 10 for the generation of heat pulses. The register ODD 402 and the register EVEN 403 are selected alternately to suit to a procedure in which the register ODD 402 is used if an odd-numbered encoder pulse is transferred from the linear encoder portion (not shown) while the register EVEN 403 is used if an even-numbered encoder pulse is transferred therefrom. Thus, the delay-setting register 402 or 403 generates a heat pulse after the time interval between the time of rising of an encoder pulse generated from the linear encoder portion and the predetermined delay time. A time counter ODD 400 and a time counter EVEN 401 are counters that measure the time interval between the generation of the heat pulse and the generation of the encoder pulse to provide the amount of delay (i.e., actual delay time) with respect to the register ODD 402 and the register EVEN 403, respectively. Then, the data currently held in the register 402 or 403 can be cleared when the corresponding encoder pulse falls and subsequently the register 402 or 403 is synchronized with a basic clock CLK. A comparator circuit ODD 404 or a comparator circuit EVEN 405 compares the predetermined delay time set in the register 402 or 403 and the actual delay time obtained by the time counter 400 or 401 and determines whether they are equal. The comparator circuits 404, 405 generate HTG1 and HTG2 signals respectively at the time after passing the predetermined delay time from the time of falling of the encoder pulse.

Figure 7:
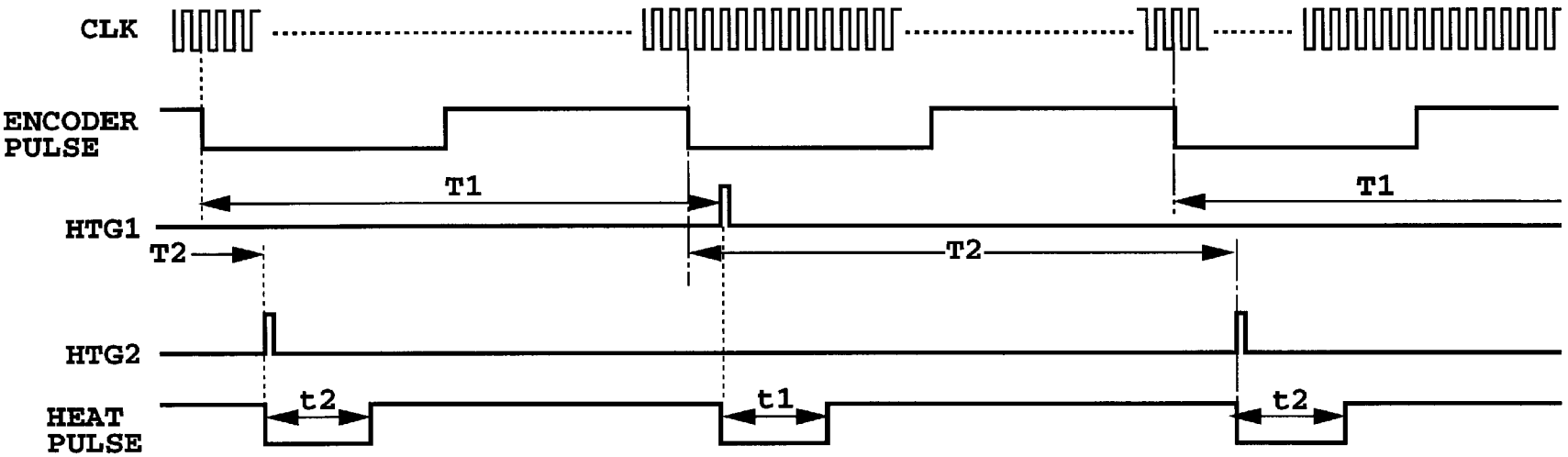
FIG. 7 is a timing chart for each signal in the main section of the inkjet printing apparatus shown in FIG. 6.

FIG. 7 is an explanation diagram in which a delay time T1 is provided as a delay-setting time in the delay-setting register ODD 402 and a delay time T2 is provided as a delay-setting time in the delay-setting register EVEN 403. The time counter ODD 400 starts to count the number of pulses from the instant when the odd-numbered encoder pulse falls. Every value counted by the time counter ODD 400 is constantly compared with the delay time (the predetermined delay time) T1 by the comparator circuit ODD 404. If the value and the delay time Ti are equal, then the comparator circuit ODD 404 generates a HTG 1 signal as a high pulse just after the time T1. Regarding the time counter EVEN 401, on the other hand, it starts to count the number of pulses from the instant when the even-numbered encoder pulse falls. Every value counted by the time counter EVEN 401 is constantly compared with the delay time (the predetermined delay time) T2 by the comparator circuit EVEN 405. If the value and the delay time T2 are equal, then the comparator circuit EVEN 405 generates a HTG2 signal as a high pulse just after the time T2. Both HTG1 and HTG2 signals from the comparator circuits 404, 405 pass through a selector circuit 406 to become trigger signals for generating heat pulses. Then, the trigger signals are transferred to a heat-pulse generator circuit 407. The heat-pulse generator circuit 407 generates heat pluses in accordance with the trigger pulses. Subsequently, the head portion 18 receives heat pulses from the heat-pulse generator circuit 407. The widths t1 and t2 of the heat pulses correspond to the amount of energies to be determined by heat characteristics of the printing head for ejecting ink and the current temperature of the printing head. In the figure, each of the heat pulses is represented as a single pulse. However, it is not limited to such a pulse. It is also possible to represent it as double pulses or the like.

Figure 8:
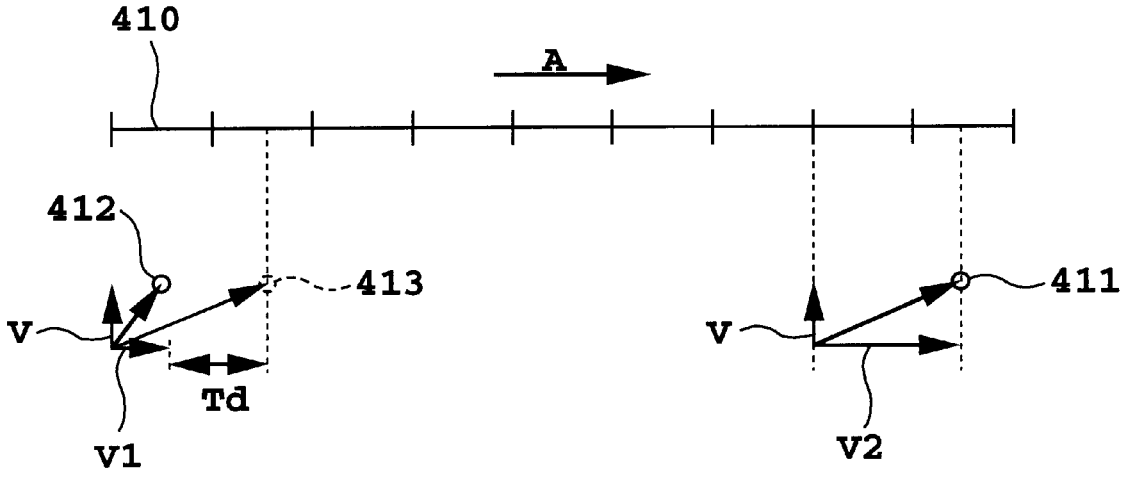
FIG. 8 is an explanation view for illustrating the timing of ejecting ink in accordance with the first embodiment of the present invention.

Referring now to FIG. 8, we will describe the reasons of generating the heat pulses at the intervals of delay times defined by the delay-setting registers 402, 403.

In the figure, the reference numeral 410 denotes a scale provided as a system of ordered marks at fixed intervals used as a reference standard in measurement of a printing resolution on a surface of the printing paper 105, in which the above fixed interval corresponds to the spacing between two neighboring dots in the direction of main-scanning. In addition, the velocity of an ink droplet ejected from the printing head is represented by "V" and the velocity of the carriage during the step of printing an image on the printing paper is represented by "V2". If the ink droplet ejected from the printing head on the carriage being moved at a constant velocity of "V2" is placed on a position 411, the position 411 differs from an ink ejecting position by a width of 1.5 dots in the direction of main-scanning. If the ink droplet ejected from the printing head on the carriage being accelerated (i.e., just moving at a velocity of "V1") is placed on a position 412, this position 412 is at a location some distance from a position 413 that corresponds to the carriage being moved at a constant velocity of"V2". For coinciding the position 412 with the position 413, the time of starting the ejection of ink may be delayed by a time interval "Td". The delay time "Td" is a value that can be uniquely determined with response to the carriage speed, so that the dots to be placed on the printing paper can be equally spaced as a result of changing the delay values of the delay-setting registers 402, 403 in real time in response to the carriage speed. In this case, by the way, it is needless to say that the spacing between the printing head and the printing paper is fixed.

Set values of the delay times for the delay-setting registers ODD 402 and EVEN 403 can be changed depending on the carriage speed calculated by measuring the cycle of the encoder pulse as described above. Therefore, the dots to be placed on the printing paper can be equally spaced. Hereupon, an amount of displacement from the position at which an ink droplet is ejected from the printing head to the position at which the ink droplet is placed in the direction of main-scanning can be calculated as follows, for example, if we assume that a printing resolution is 600 dpi, a velocity of the ink droplet ejected from the printing head is 20 m/sec., a refill frequency of the ink is 20 kHz, and the spacing between the printing head and the printing paper is 1.5 mm.

$$(1.5\ (\text{mm})/20\ (\text{m/s}))\times 846.66\ (\text{mm/s})=63.5\ (\mu\text{m})$$

This amount of displacement corresponds to 1.5 dots at the spacing of 600 dpi. That is, it is required that the delay-setting value be modified so that the time of ejecting the ink is delayed for 1.5 dots. If the number of means for setting the delay time (i.e., the delay-setting register) is only one, the heat-pulse generation trigger signal cannot be generated because the time counter reset is performed every time in response to the falling edge of the encoder pulse. To solve this problem, the present embodiment has two delay-setting means (i.e., the delay-setting registers 402, 403).

In the present embodiment, there are two delay-setting systems (i.e., the delay-setting registers 402, 403). However, the number of the delay-setting systems is not limited to two. It is also possible to construct three or more delay-setting systems (i.e., 3, 4, n−1, n systems) in accordance with at least one of parameters including printing resolutions, ink-refill frequencies, and spacing between the printing head and the printing paper. If the number of the delay-setting systems is "n" and the sequence number 0 (zero) is assigned to the first delay-setting register, heat-pulse generation trigger signals are generated by the heat-pulse generator circuit 407 in response to the sequence of 0, 1, 2, n−1 of the delay-setting registers.

Figure 9A:
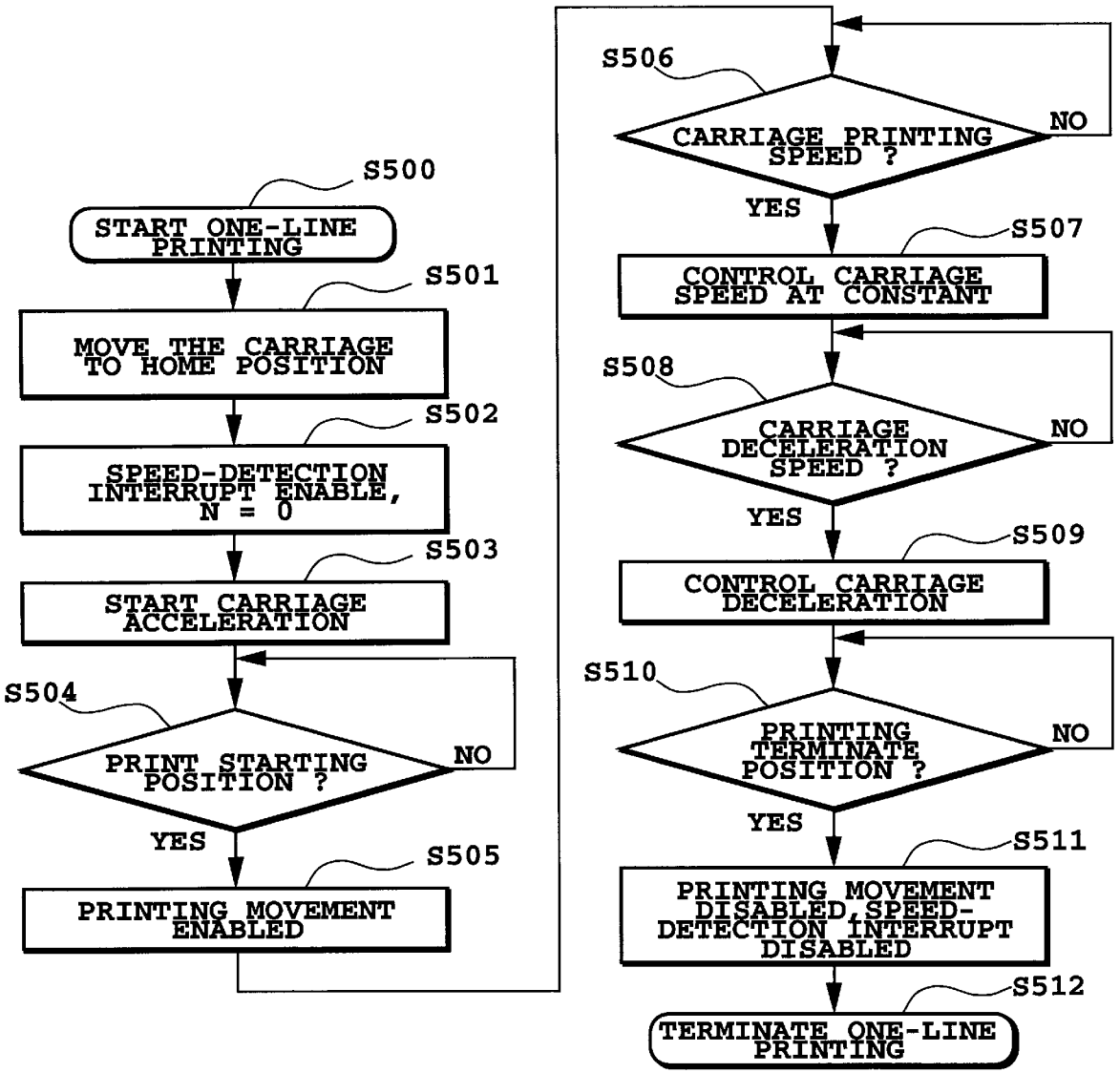
FIG. 9A and FIG. 9B are flow charts for illustrating the printing movement in accordance with the first embodiment of the present invention.
Figure 9B:
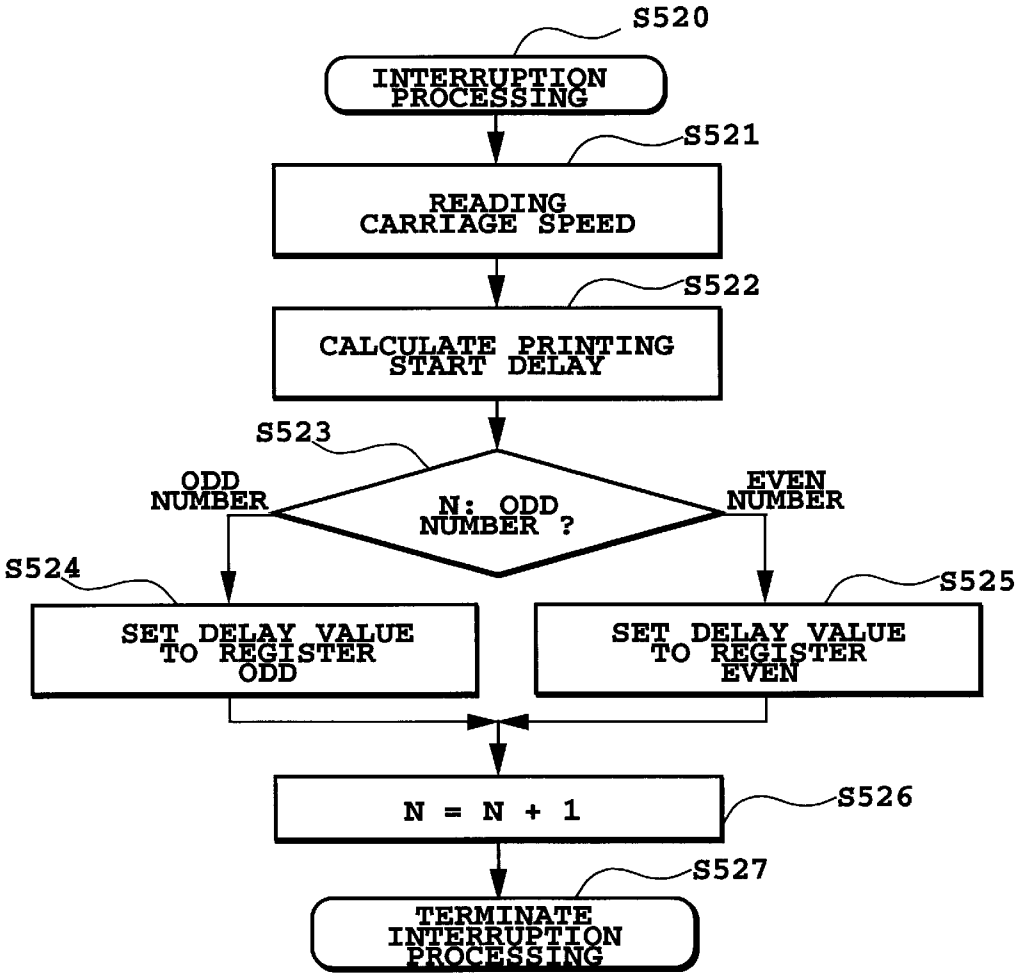

Referring now to flow charts in FIG. 9A and FIG. 9B, we will describe the variable operation of heat timing in accordance with the present embodiment.

FIG. 9A is a flow chart that illustrates the procedure for controlling the operation of printing one line on a sheet of printing paper by means of the control portion 10. At first, one-line printing is started at the step "S500" and the carriage 102 is shifted to its home position by controlling the mechanism drive portion 13 at the step "S501". During the subsequent step (S502), a speed-detection interrupt handling routine is enabled and a variable "N" for encoder pulse count is cleared to "0". As described above, the speed detection interrupt is an interrupt to be generated whenever the speed detection is completed by the carriage-speed detection portion 11. The speed detection is performed periodically in response to the generation of encoder pulses, so that the number of interrupts to be generated corresponds to the number of the encoder pulses.

FIG. 9B is a flow chart that illustrates the processing that takes place when requested by means of an interrupt generated as a result of the speed detection. After the speed detection procedure has been completed by the speed-detection portion 11, an interrupt signal occurs to start the interrupt processing. The interrupt signal is transferred to the control portion 10 and then an interruption processing is executed at the step "S520". During the processing, at first, carriage-speed data is read out from the carriage-speed detection portion (step "S521") and then the amount of initial delay at the beginning of the printing in response to the carriage speed is calculated at the step "S522". Subsequently, the calculated amount of the delay at the beginning of the printing is loaded into the delay-setting register ODD at the steps "S523" and "S524" if a variable "N" for the current encoder pulse count is an odd number. Alternatively, the calculated amount of the delay at the beginning of the printing is loaded into the delay-setting register EVEN at the steps "S523" and "S525" if a variable "N" for the current encoder pulse count is an even number. Then, the variable N for the encoder pulse count is incremented by 1, resulting in the value "N+1" at the step "S526". Consequently, the interruption processing is terminated at the step "S527".

As can be seen from the above interruption processing, the linear encoder portion generates encoder pulses during the movement of the carriage 102 by enabling the speed-detection interruption processing. The carriage-speed detection portion 11 detects the speed of the carriage whenever one cycle of periodically repeated generation of encoder pulses is completed. Simultaneously, the control portion 10 sets the amount of the delay in response to a variation in the carriage speed in real time to the head controller 17, so that the timing of ink-ejection can be appropriately adjusted.

Referring again to the flow chart in FIG. 9A, the printing movement of the present embodiment is further described. In the step "S503", the control portion 10 permits the initiation of accelerating the carriage speed in the direction of main-scanning. The acceleration movement of the carriage is performed with reference to an acceleration table which is defined on the basis of the application of load to the mechanism drive portion and the torque characteristics of the motor 103. During the step of accelerating the carriage, the printing movement is enabled when the encoder information detects the arrival of the carriage at the position for starting printing. Then, the head controller 17 and the memory controller 15 get permission to perform the printing movement (steps "S504" and "S505"). Thus, the head controller 17 is synchronized with the falling edge of the encoder pulse and supplies heat pulses to the head portion 18 with the delay corresponding to the times of delay defined by the delay-setting registers 402, 403. Consequently, the head portion 18 prints an image on a sheet of printing paper in response to the heat pulses. Actually, the above steps are performed in parallel with the receiving of data from a host computer, the write operation on the memory portion 16, and so on. However, these events are not directly related to the present embodiment and also they can be easily understood by the person skilled in the art. In the interest of simplicity, therefore, the description of these events will be omitted from the following discussion.

If the carriage 102 reaches the predetermined speed for printing an image on the printing paper, the mechanism drive portion 13 is switched from an acceleration control mode to a constant speed control mode with respect to control the speed of the carriage (steps "S506" and "S507"). Under the constant speed mode of the carriage 102, as described above, the carriage speed is detected and the amount of the delay in response to variations in the speed of the carriage 102 is established for avoiding variations in the positions on which ink droplets are placed. When the carriage 102 arrives at the position for starting the deceleration, the mechanism drive portion 13 is switched from the constant speed control mode to a deceleration control mode with respect to control the speed of the carriage (steps "S508" and "S509"). Under the deceleration control mode, the speed detection interrupt is in the enable state, so that the detection of the carriage speed and the setting of the amount of the delay are performed at all times to adjust the positions on which ink droplets are placed during the printing movement. Finally, the carriage arrives at a print-terminating position. Thus, the printing movement is terminated and the head controller 17 enters in a state of disabling the printing movement (steps "S510" and "S511"). Subsequently, the carriage comes to a full stop (not shown in the flow chart) and thus the operation of printing one line on a sheet of printing paper is terminated (step "S512").

Repeating the one-line printing procedure described above allows printing with excellent image quality without causing any variations in the positions of ink dots on the printing medium in spite of performing the printing at the times of accelerating and decelerating the carriage 102.

According to the present embodiment, as described above, the detection of the carriage speed is performed by the carriage-speed detection portion 11. However, it is also possible to detect the carriage speed by directly entering encoder pulses into the control portion 10 of the microprocessor and then detecting the carriage speed by means of input capture function of the microprocessor. Depending on the type of the printing head, a plurality of nozzles may be divided into several blocks and then a delay time (i.e., the difference in times of ejecting ink form different blocks) is established for each block. Thus, the printing head prints an image on a sheet of printing paper by activating nozzles of each block independently or more than one block at the same time. The printing head having such a configuration may further include a plurality of delay means that sets the times of the generation of heat pulses in response to variations in the speed of the printing head so that they are arranged in alternating time periods and a delay means for staggering the delay times of the corresponding blocks. Therefore, the printing head performs the printing with equally spaced dots even when the carriage 102 is accelerating.

Second Embodiment

An inkjet printing apparatus of the second embodiment in accordance with the present invention has the same block configuration as that of the first embodiment shown in FIG. 1, except that the amount of delay in response to the carriage speed is only established when the printing speed of the carriage is kept at a constant. Conventionally, it would be difficult to adjust the positions on which ink dots are placed so as to be equally spaced because variations in the speed of the carriage are generated by means of mechanical load fluctuation in spite of driving the carriage at a constant speed. According to the present invention, however, it is possible to adjust the positions on which ink dots are placed so as to be equally spaced by establishing the amount of delay in response to the carriage speed.

Referring now to flow charts of FIG. 10A and FIG. 10B, hereinafter, the one-line printing operation to be performed by the second embodiment is described.

Figure 10A:
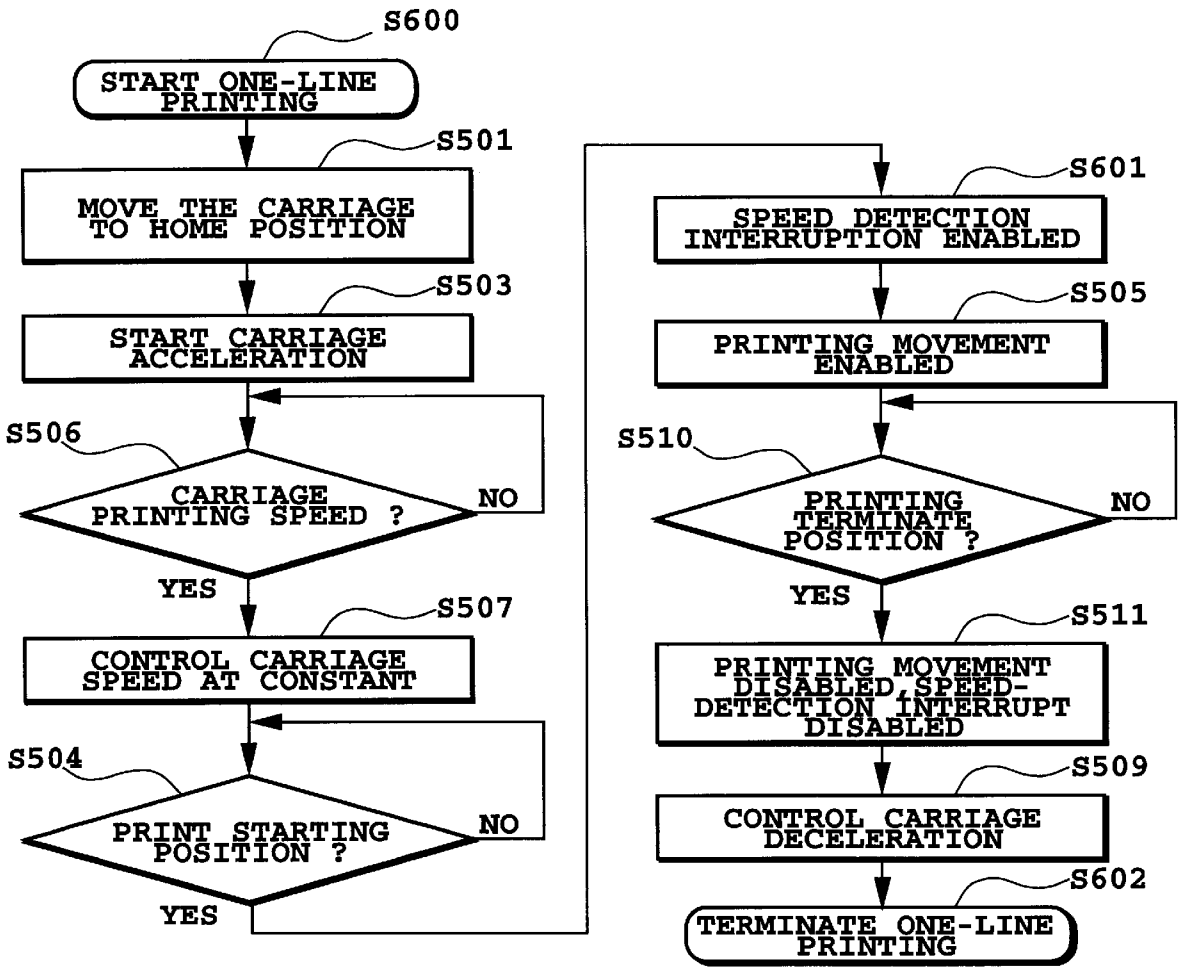
FIG. 10A and FIG. 10B are flow charts for illustrating the printing movement in accordance with the second embodiment of the present invention.
Figure 10B:
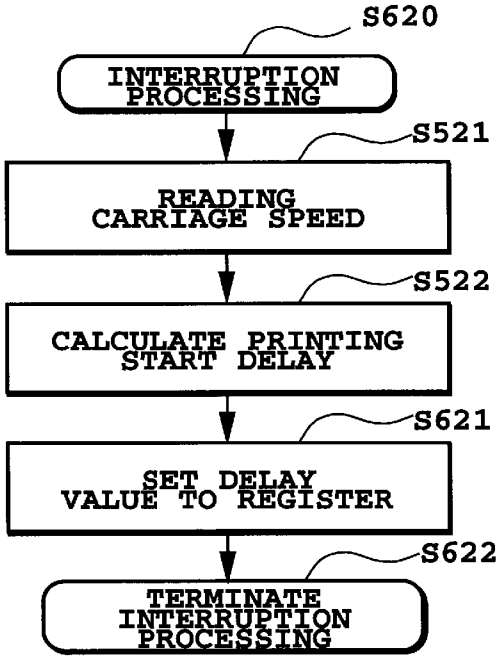

In the flow charts of FIG. 10A and FIG. 10B, the same steps as those shown in FIG. 9A and FIG. 9B have the same reference numerals as those of FIG. 9A and FIG. 9B. At first, one-line printing is started at the step "S600" and the carriage 102 is shifted to its home position by controlling the mechanism drive portion 13 at the step "S501". In the step "S503", the control portion 10 permits the initiation of accelerating the carriage 102 in the direction of main-scanning. The acceleration movement of the carriage 102 is performed with reference to an acceleration table which is defined on the basis of the application of load to the mechanism drive portion and the torque characteristics of the motor 103. When the carriage 102 reaches the predetermined speed for printing an image on the printing paper, the mechanism drive portion 13 is switched from an acceleration control mode to a constant speed control mode to control the speed of the carriage (steps "S506" and "S507"). The second embodiment does not perform the printing at the time of accelerating the carriage as in the conventional case, so that a position where the printing head starts the printing is downstream from a position at which the carriage gains speed for performing the printing operation.

When the encoder information detects the arrival of the carriage at the position for starting the printing, a speed-detection interrupt handling routine (see FIG. 10B) is enabled (steps "S504" and "S601").

Then, the head controller 17 and the memory controller 15 get permission to perform the printing movement (step "S505"). Thus, the head controller 17 is synchronized with the falling edge of the encoder pulse and supplies heat pulses to the head portion 18 with the delay corresponding to the times of delay defined by the delay-setting registers 402, 403. Consequently, the head portion 18 prints an image on a sheet of printing paper in response to the heat pulses. In the first embodiment, timing signals for ejecting ink from the printing head are generated by switching a plurality of delay-setting registers 402, 403. In the second embodiment, on the other hand, there is no need to use two or more delay-setting registers because of a precondition that the printing is performed when the carriage 102 is moving at a constant speed. Thus, a single delay-setting register may be used in this embodiment. In FIG. 10B, a speed-detection interruption processing (step "S620") comprises the steps of reading out carriage-speed data from the carriage-speed detection portion (step "S521"); calculating the amount of initial delay at the beginning of the printing in response to the carriage speed (step "S522"); setting the calculated amount of the delay at the beginning of the printing into a delay-setting register (step "S621"); and terminating the interruption processing (step "S622"). Accordingly, the present embodiment calculates the amount of delay in response to the carriage speed in the speed-detection interruption processing of FIG. 10B and the calculated value is set in the delay-setting register. Thus, the timing of ink-ejection from the printing head is shifted depending on the variations in the speed of the carriage 102 to adjust the positions on which ink droplets are placed so as to be equally spaced. The control portion 10 detects that the carriage 102 has arrived at the position for terminating the printing from the encoder information (step "S501"). The head controller 17 enters a state of disabling the printing movement and also the carriage-speed detection interrupt enters a disable state (steps "S510" and "S511"), so that the printing operation is terminated. The carriage 102 is decelerated by controlling the mechanism drive portion 13 (step "S509"). Subsequently, the carriage 102 comes to a full stop to terminate the operation of printing one line on a sheet of printing paper (step "S602").

As can be seen from the above description, the printing apparatus of the second embodiment establishes the amount of delay in response to the carriage speed only when the printing speed of the carriage is kept at a constant. Therefore, it is possible to adjust the positions on which ink dots are placed so as to be equally spaced by establishing the amount of delay in response to the carriage speed even though variations in the speed of the carriage are generated by means of mechanical load fluctuation.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing apparatus for printing an image on a printing medium on the basis of image data by actuating a printing head during a scanning movement of the printing head, comprising:

position detecting means for detecting a position of the printing head during the scanning movement;

a plurality of registers, each for storing a delay time from a detecting time of the position detecting means to a time for actuating the printing head; and compensating means for establishing the time for actuating the printing head by using the delay times stored in the plurality of registers in order, in response to a position detecting signal of the position detecting means.

2. The printing apparatus as claimed in claim 1, wherein a plurality of printing heads are provided for printing a color image with a plurality of color pixels; and a plurality of the delay time compensating means are provided for establishing the delay times for each of the printing heads.

3. The printing apparatus as claimed in claim 1, wherein the printing head is installed on a carriage to move together with the carriage in the scanning movement of the printing head; and the position detection means detects the position of the carriage.

4. The printing apparatus as claimed in claim 1, further comprising:

speed detecting means for detecting a scanning speed of the printing head; and delay time compensating means for establishing the delay times stored in the plurality of registers in response to the scanning speed detected by the speed detecting means.

5. The printing apparatus as claimed in claim 4, wherein the speed detecting means continuously detects the scanning speed of the printing head whenever the position of the printing head is shifted a predetermined distance.

6. The printing apparatus as claimed in claim 4, wherein the speed detecting means comprises:

an encoder for generating a pulse whenever the position of the printing head is shifted a predetermined distance; and a detection portion for detecting the scanning speed of the printing head based on an interval of the pulses generated by the encoder.

7. The printing apparatus as claimed in claim 4, wherein the delay time compensating means is comprised of a plurality of compensating portions for continuously establishing the delay times stored in the plurality of registers in response to the scanning speed detected by the speed detecting means.

8. The printing apparatus as claimed in claim 4, wherein the speed detecting means detects variations in the scanning speed of the printing head during the scanning movement of the printing head so as to maintain the printing head at a predetermined scanning speed; and the delay time compensating means establishes the delay times in response to the variations in the scanning speed detected by the speed detecting means to equally space pixels to be printed on the printing medium.

9. The printing apparatus as claimed in claim 4, wherein in at least one of a period during which the printing head is accelerated up to a predetermined scanning speed and a period during which the printing head is decelerated from the scanning speed, the delay time compensating means establishes the delay times in response to the scanning speed detected by the speed detecting means to equally space pixels to be printed on the printing medium.

10. The printing apparatus as claimed in claim 4, wherein the printing head is an inkjet printing head which ejects ink on the basis of the image data; and the delay time compensating means establishes the delay times until ejecting ink from the printing head.

11. The printing apparatus as claimed in claim 10, wherein the printing head has a plurality of electrothermal elements that generate thermal energy to be used as energy for ejecting ink.

12. A method for printing an image on a printing medium on the basis of image data by actuating a printing head during a scanning movement of the printing head, comprising the steps of:

detecting a position of the printing head during the scanning movement;

storing in each of a plurality of registers a delay time from a time of detecting the position of the printing head to a time for actuating the printing head; and establishing the time for actuating the printing head by using the delay times stored in the plurality of registers in order, in response to a position detecting signal generated in the printing head position detecting step.

* * * * *

UNITED STATES PATENT AND TRADEMARK OFFICE

CERTIFICATE OF CORRECTION

PATENT NO. : 6,419,338 B1
DATED : July 16, 2002
INVENTOR(S) : Ikeda

It is certified that error appears in the above-identified patent and that said Letters Patent is hereby corrected as shown below:

Column 6,
Line 32, "Ti" should read -- T1 --.

Signed and Sealed this

Twenty-fifth Day of February, 2003

JAMES E. ROGAN
*Director of the United States Patent and Trademark Office*